US009353675B2

(12) United States Patent
Grether et al.

(10) Patent No.: US 9,353,675 B2
(45) Date of Patent: May 31, 2016

(54) TWO-STROKE ENGINE

(75) Inventors: Michael Grether, Waiblingen (DE); Robert Köhli, Winnenden (DE); Stefan Kummermehr, Berglen (DE)

(73) Assignee: ANDREAS STIHL AG & CO. KG, Waiblingen (DE)

( * ) Notice: Subject to any disclaimer, the term of this patent is extended or adjusted under 35 U.S.C. 154(b) by 168 days.

(21) Appl. No.: 13/326,974

(22) Filed: Dec. 15, 2011

(65) Prior Publication Data

US 2012/0152217 A1 Jun. 21, 2012

(30) Foreign Application Priority Data

Dec. 16, 2010 (DE) ..... 10 2010 054 839

(51) Int. Cl.
*F02B 25/00* (2006.01)
*F02B 33/04* (2006.01)

(52) U.S. Cl.
CPC ..... *F02B 33/04* (2013.01)

(58) Field of Classification Search
CPC .... F02B 27/02; F02B 2075/025; F02B 33/04; F02B 25/22; F02M 9/026; F02M 11/06; F02M 3/07; F02M 3/12; F02M 3/14; F02M 7/22; F02M 7/225; F02M 7/24; F02M 7/26; F02M 9/12; F02M 9/124; F02M 9/127; F02M 11/10; F02M 11/105; F02M 17/08; F02M 17/09; F02M 17/10; F02M 17/12; F02M 17/147
USPC .... 123/73 R, 184.52, 337, 65 R, 73 A, 73 PP
See application file for complete search history.

(56) References Cited

U.S. PATENT DOCUMENTS 5,632,792 A 5/1997 Haggard
7,013,851 B2 3/2006 Prager
(Continued)

FOREIGN PATENT DOCUMENTS

CN 2069486 U 1/1991
CN 1661214 A 8/2005
(Continued)

OTHER PUBLICATIONS

Grether; U.S. PTO Office Action, U.S. Appl. No. 13/327,020, Feb. 5, 2014, 12 pgs.
(Continued)

*Primary Examiner* — Lindsay Low
*Assistant Examiner* — Omar Morales
(74) *Attorney, Agent, or Firm* — Paul D. Strain, Esq.; Strain & Strain PLLC

(57) ABSTRACT

A two-stroke engine has a cylinder with a combustion chamber which is bounded by a piston which drives a crankshaft which rotates in a crankcase. The crankcase is connected to the combustion chamber via an overflow passage in the lower dead center region of the piston. The two stroke engine has an intake passage. A carburetor forms a section of the intake passage. The intake passage is partially divided into an air passage, which supplies combustion air into an overflow passage, and a mixture passage which opens into the crankcase. A throttle valve mounted pivotably in the carburetor controls the combustion air quantity supplied to the air and mixture passages. An air-guiding element arranged on the passage wall of the air passage guides the combustion air passing between the throttle valve and passage wall in the idling position of the throttle valve in the direction of the mixture passage.

13 Claims, 3 Drawing Sheets

(56) References Cited

U.S. PATENT DOCUMENTS

| | | | | |
|---|---|---|---|---|
| 7,258,327 | B2 * | 8/2007 | Prager | 261/46 |
| 7,374,155 | B2 | 5/2008 | Tobinai | |
| 2006/0125125 | A1 | 6/2006 | Seki et al. | |
| 2006/0151892 | A1 | 7/2006 | Tobinai | |
| 2006/0219194 | A1 | 10/2006 | Geyer et al. | |
| 2007/0272188 | A1 | 11/2007 | Geyer et al. | |
| 2008/0276904 | A1 | 11/2008 | Surnilla et al. | |
| 2009/0007894 | A1 * | 1/2009 | Wada et al. | 123/73 V |
| 2009/0188461 | A1 * | 7/2009 | Kummermehr et al. | 123/184.52 |
| 2009/0228189 | A1 | 9/2009 | Zurcher et al. | |
| 2012/0152216 | A1 | 6/2012 | Grether | |

FOREIGN PATENT DOCUMENTS

| | | | |
|---|---|---|---|
| CN | 1818366 | A | 8/2006 |
| DE | 10 2004 009 310 | A1 | 9/2005 |
| DE | 10 2005 003 559 | A1 | 8/2006 |
| JP | 2001-295652 | A | 10/2001 |
| JP | 2006-283758 | A | 10/2006 |
| JP | 2009-209939 | A | 9/2009 |
| WO | WO 2012/063276 | A1 | 5/2012 |

OTHER PUBLICATIONS

Grether; U.S. PTO Notice of Allowance, U.S. Appl. No. 13/327,020, Nov. 6, 2014, 7 pgs.

Chinese Search Report, Appl. No. 201110436760.3, Feb. 4, 2015, 4 pgs.

Grether; U.S. PTO Office Action, U.S. Appl. No. 13/327,020, Jul. 17, 2014, 13 pgs.

* cited by examiner

TWO-STROKE ENGINE

CROSS-REFERENCE TO RELATED PATENT APPLICATIONS

This application is based upon and claims the benefit of priority from prior German Patent Application No. 10 2010 054 839.1, filed Dec. 16, 2010 the entire contents of which are incorporated herein by reference in their entirety.

BACKGROUND

The invention relates to a two-stroke engine of the type having a cylinder, in which a combustion chamber is formed, wherein the combustion chamber is bounded by a piston which drives a crankshaft mounted rotatably in a crankcase, wherein the crankcase is connected in the region of the lower dead center of the piston via at least one overflow passage to the combustion chamber, with an intake passage, wherein a section of the intake passage is formed in a carburetor, wherein the intake passage is at least partially divided into an air passage and a mixture passage, wherein the mixture passage opens into the crankcase and the air passage supplies combustion air to an overflow passage, and wherein a throttle valve is mounted pivotably in the carburetor, and controls the combustion air quantity supplied to the air passage and the mixture passage, wherein an air-guiding element is arranged on the passage wall of the air passage, the air-guiding element guiding the combustion air passing between the throttle valve and passage wall in the idling position of the throttle valve in the direction of the mixture passage. JP 2001-295652 A discloses a two-stroke engine operating with a scavenging gas shield, in which a common throttle valve for an air passage and mixture passage is arranged in the intake passage. In order to open the air passage subsequently, the air passage wall arranged adjacent to the border of the throttle valve is of curved design and sealed off from the throttle valve. The air passage and mixture passage are completely separated from each other in a sealed manner.

SUMMARY OF THE INVENTION

It is one object of the invention to provide a two-stroke engine of the type discussed above, which is of simple construction and has stable running behavior at low rotational speeds.

This and other objects are achieved by a two-stroke engine with a cylinder, in which a combustion chamber is formed, wherein the combustion chamber is bounded by a piston which drives a crankshaft mounted rotatably in a crankcase, wherein the crankcase is connected in the region of the lower dead center of the piston via at least one overflow passage to the combustion chamber, with an intake passage, wherein a section of the intake passage is formed in a carburetor, wherein the intake passage is at least partially divided into an air passage and a mixture passage, wherein the mixture passage opens into the crankcase and the air passage supplies combustion air to an overflow passage, and wherein a throttle valve is mounted pivotably in the carburetor, and controls the combustion air quantity supplied to the air passage and the mixture passage, wherein an air-guiding element is arranged on the passage wall of the air passage, the air-guiding element guiding the combustion air passing between the throttle valve and passage wall in the idling position of the throttle valve in the direction of the mixture passage. The air-guiding element guides the air passing between the throttle valve and passage wall in the direction of the mixture passage. At the same time, fuel which has entered the air passage can also be conveyed back to the mixture passage. As a result, accumulations of fuel in the air passage can be avoided.

Further objects, features and advantages of the present invention will become apparent from the detailed description of preferred embodiments of the invention which is set forth below, when considered together with the figures of drawing.

BRIEF DESCRIPTION OF THE DRAWINGS

An exemplary embodiment of the invention is explained below with reference to the drawing, in which.

DETAILED DESCRIPTION OF PREFERRED EMBODIMENTS

Figure 1:
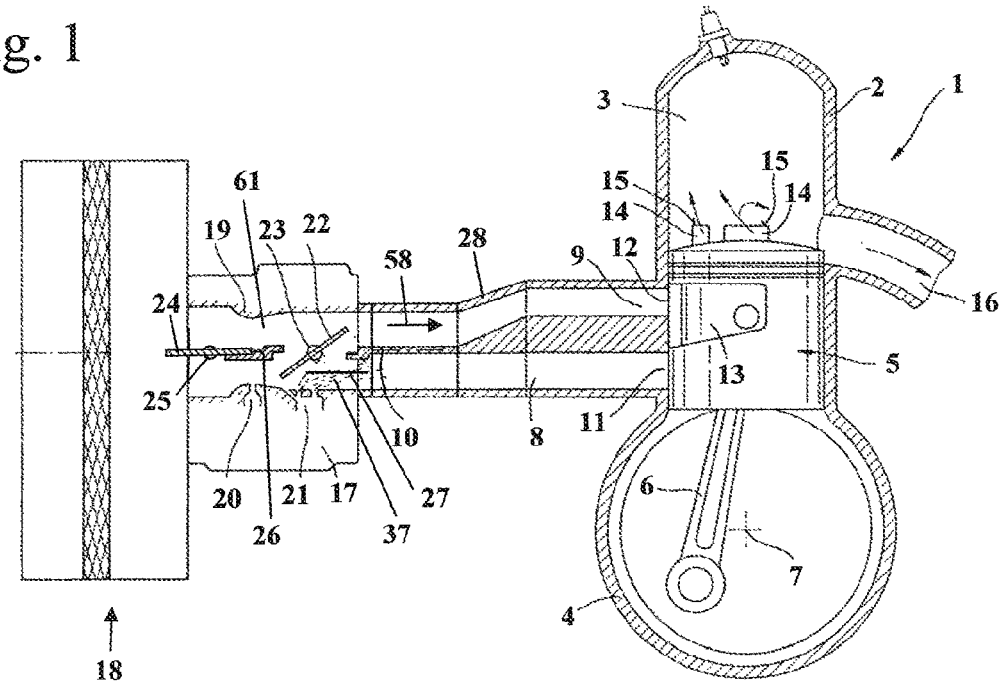
FIG. 1 shows a schematic sectional illustration of a two-stroke engine.

In the idling position of the throttle valve, the air-guiding element is advantageously arranged adjacent to the border of the throttle valve. A gap is advantageously formed between the border of the throttle valve and the air-guiding element. The width of the gap is preferably approximately 3% to approximately 10% of the diameter of the throttle valve. The gap here is dimensioned in such a manner that the throttle valve cannot become jammed even in the event of unfavorable tolerances.

The air passage and the mixture passage are advantageously at least partially separated from each other by a separating wall. The throttle valve is mounted pivotably in particular by means of a throttle valve. In the idling position of the throttle valve, the air passage and the mixture passage are advantageously connected via an opening, which is arranged downstream of the throttle shaft, in the separating wall. The air deflected by the air-guiding element flows in particular through the opening in the separating wall. The effect can thereby be achieved in a simple manner that the air flowing in with the throttle valve only slightly open is supplied to the crankcase substantially via the mixture passage. This avoids fuel from being able to accumulate in the air passage during idling and at low rotation speeds. The air-guiding element advantageously has a flow separation edge, wherein the tangent to the flow separation edge in particular intersects the opening in the separating wall. The effect can thereby be achieved in a simple manner that the combustion air which is guided by the air-guiding element in the direction of the mixture passage flows through the opening in the separating wall into the mixture passage.

A simple configuration is produced if an intermediate ring is arranged downstream of the carburetor, the air-guiding element being integrally formed on the intermediate ring. Structural modifications to the carburetor can thereby be avoided. A simple configuration is produced if the intermediate ring is of thickened design on the side bounding the air passage, the air-guiding element being formed on the thickened portion. A separating wall section is advantageously formed on the intermediate ring. In this case, the separating wall which is formed on the intermediate ring advantageously protrudes both into the region of the carburetor and also downstream beyond the end side of the intermediate ring. In particular, a connecting stub is arranged downstream of the carburetor, the intermediate ring being arranged between the carburetor and connecting stub. In this case, the separating wall section which is formed on the intermediate ring advantageously protrudes into the connecting stub. The air-guiding element is advantageously of curved design in cross section. In particular, the air-guiding element is designed as a radius on the thickened portion. The radius here does not absolutely have to follow the pivoting radius of the throttle valve but rather may be selected to be significantly smaller, thus simplifying the configuration. The gap width of the gap formed between the border of the throttle valve and the air-guiding element is not constant here along the direction of flow.

Turning now to the figures, FIG. 1 schematically shows a two-stroke engine 1, as can be used, for example, for driving a tool in hand-guided working implements, such as motor-driven saws, abrasive cutting-off machines, brush cutters or the like. The two-stroke engine 1 has a cylinder 2, in which a combustion chamber 3 is formed. The combustion chamber 3 is bounded on one side by a piston 5 which is mounted such that it moves to and fro in the cylinder 2 and, via a connecting rod 6, drives a crankshaft 7, which is mounted rotatably in a crankcase 4. In the lower dead center of the piston 5, the interior of the crankcase 4 is connected to the combustion chamber 3 via overflow passages 14 which open by means of overflow apertures 15 into the combustion chamber 3. An outlet 16 for exhaust leads out of the combustion chamber 3. The two-stroke engine 1 has an intake passage 61 which is connected to an air filter 18 and via which combustion air is sucked up. A section of the intake passage 61 is formed in a carburetor 17. A choke valve 24 with a choke shaft 25, and also, downstream of the choke valve 24, a throttle valve 22 with a throttle shaft 23 are mounted pivotably in the carburetor 17, which is designed in the exemplary embodiment as a diaphragm-type carburetor. Instead of the throttle valve 22, a different throttle element may alternatively be provided, and instead of the choke valve 24, a different choke element may alternatively be provided. Downstream of the throttle valve 22, the intake passage 61 is separated by a separating wall 10 into a mixture passage 8 and an air passage 9. A separating wall section 26 is arranged between the throttle valve 22 and choke valve 24. A main fuel opening and a plurality of idling fuel openings 21 in the carburetor 17 open into the mixture passage 8. The idling fuel openings 21 open into the mixture passage 8 downstream of the main fuel opening 20. In the region of the main fuel opening 20, a Venturi 19 is formed in the intake passage 61. The mixture passage 8 opens with a mixture inlet 11 on the cylinder 2 and the port is controlled by the piston 5. The air passage 9 opens with an air inlet 12 on the cylinder 2. The piston 5 has one or more piston recesses 13 which connect the air inlet 12 in the region of the upper dead center of the piston 5 to the overflow apertures 15. The air passage 9 may also be divided into two branches which each open with a separate air inlet 12 on the cylinder 2.

During operation, a fuel/air mixture is sucked up into the crankcase 4 via the mixture inlet 11 during the upward stroke of the piston 5. In the region of the upper dead center, largely fuel-free combustion air from the air passage 8 is temporarily stored in the overflow passages 14. During the downward stroke of the piston 5, the fuel/air mixture in the crankcase 4 is compressed and enters the combustion chamber 3 in the region of the lower dead center of the piston 5. In the process, the air temporarily stored in the overflow passages 14 first of all flows into the combustion chamber 3. During the subsequent upward stroke of the piston 5, the fuel/air mixture is once again compressed in the combustion chamber 3 and ignited in the region of the upper dead center of the piston 5. During the subsequent downward stroke of the piston 5, the outlet 16 is opened, and the exhaust gases flow out of the combustion chamber 3 and are expelled by the combustion air flowing in subsequently via the overflow passages 14.

The combustion air flows in the intake passage 61 in a direction of flow 58 from the air filter 18 to the cylinder 2. A connecting stub 28 is arranged between the carburetor 17 and cylinder 2, said connecting stub being composed of an elastic material, for example rubber or an elastomeric plastic, and in which both the mixture passage 8 and the air passage 9 are guided. A shielding element 27 which bounds a secondary passage 37 is arranged in the mixture passage 8 adjacent to the throttle valve 22. At least one idling fuel opening 21 opens into the secondary passage 37. The secondary passage 37 is arranged in the mixture passage 8 and is separated from the latter by the shielding element 27.

Figure 2:
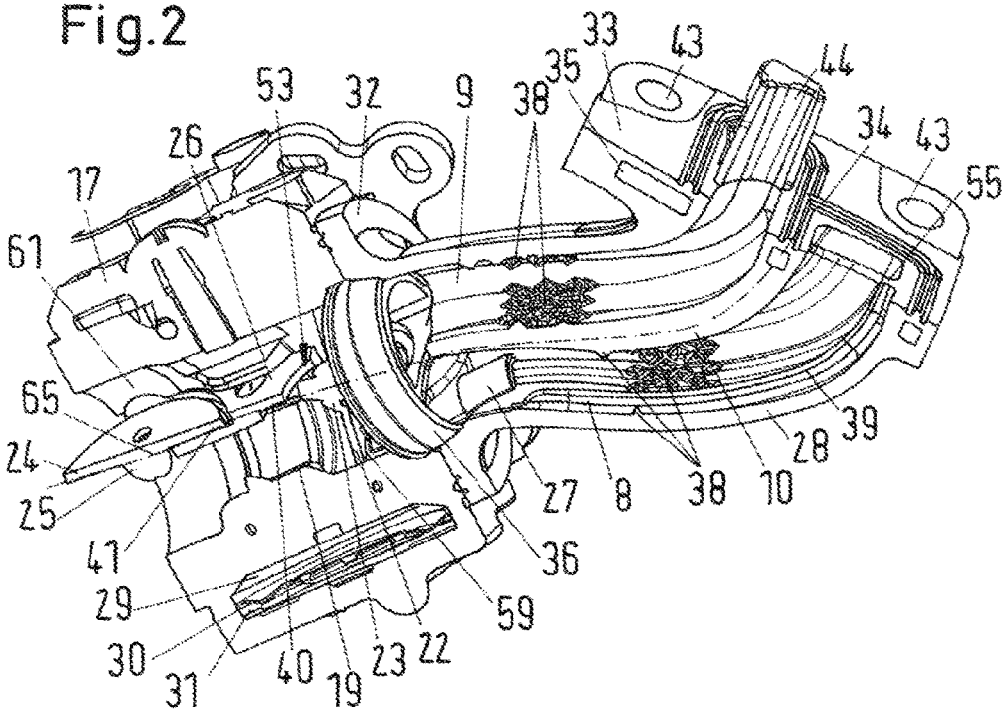
FIG. 2 shows a perspective sectional illustration through a carburetor and connecting stub of the two-stroke engine from FIG. 1.

FIG. 2 shows the configuration in detail. An intermediate ring 36 is arranged between the carburetor 17 and connecting stub 28, said intermediate ring being held in a sealing manner in both the carburetor 17 and in the connecting stub 28. The shielding element 27 is preferably integrally formed on the intermediate ring 36. The intermediate ring 36 is advantageously composed of a dimensionally stable plastic. As FIG. 2 shows, the carburetor 17 preferably has a control chamber 29 which is separated from a compensation chamber 31 via a diaphragm 30. The fuel is metered to the intake passage 61 via the control chamber 29.

As FIG. 2 also shows, the separating wall section 26 has a cutout or recess 41 on the side facing the air passage 9, against which the choke valve 24 bears. In the completely open position, the choke valve 24 preferably adjoins the separating wall section 26 in an approximately flush manner. The separating wall section 26 extends virtually as far as the choke shaft 25. The separating wall section 26 is at a distance from the throttle shaft 23. On the side facing the mixture passage 8, the separating wall section 26 has a cutout or recess 40 which is formed on a narrow border of the separating section 26 and against which the throttle valve 22 bears in the fully open position. An opening 53 is formed between the separating wall section 26 and the throttle shaft 23, via which opening the air passage 9 and the mixture passage 8 are connected to each other in the closed and only partially open position of the throttle valve 22.

The throttle valve 22 has an opening 59, the border of which, in the closed position of the throttle valve 22, is arranged on the shielding element 27 in an approximately flush manner such that combustion air from the region upstream of the throttle valve 22 can enter the secondary passage 37 through the opening 59. As FIG. 2 also shows, the shielding element protrudes both into the carburetor 17 and into the connecting stub 28.

As FIG. 2 shows, the intake passage 61 is separated in the connecting stub 28 by the separating wall 10 into an air passage 9 and mixture passage 8. Both in the air passage 9 and in the mixture passage 8, elevations 38 which are of approximately pyramid-shaped design and at which precipitated fuel can accumulate are arranged in a central region of the connecting stub 8. The fuel is gradually output again by the elevations 38 to the combustion air flowing past, thus avoiding a surge-like overflowing of fuel, for example if the two-stroke engine 1 is pivoted. In this case, the elevations in the air passage 9 are arranged upstream of the elevations in the mixture passage 8. The elevations 38 in the air passage 9 and in the mixture passage 8 do not overlap in the direction of flow 58, and therefore in each cross section located perpendicularly to the longitudinal center axis 65, elevations 38 are provided in the mixture passage 8 or in the air passage 9, or no elevations 38 are provided, i.e. elevations 38 are not provided both in the air passage 9 and in the mixture passage 8 in any cross section.

As FIG. 2 also shows, a guiding rib 39 which runs approximately in the direction of the longitudinal axis 65 of the intake passage is arranged in the mixture passage 8 on the passage side opposite the separating wall 10. In FIGS. 1 and 2, the mixture passage 8 is arranged below the air passage 9. However, in the actual installed position, the mixture passage 8 is advantageously arranged above the air passage 9 with reference to the direction of action of gravity.

The connecting stub 28 has a carburetor connection flange 32, by which said connecting stub is held on the carburetor 17. The carburetor connection flange 32 is held on the end side of the carburetor 17 via clamping elements (not shown). For connection to the cylinder 2, the connecting stub 28 has an engine connection flange 33. The engine connection flange 33 has fastening openings 43 for fastening means, for example bolts, with which the engine connection flange 33 can be screwed to the cylinder flange. In order to increase the strength, the engine connection flange 33 has a reinforcing element 35 which is injected into the material of the connecting stub 28. An encircling seal 34, which completely surrounds the mouth openings of the air passage 9 and mixture passage 8 and thus results in good sealing, is injected onto the end side. Two stubs or short feed pipes 44, of which one is shown in the sectional illustration in FIG. 2, are preferably integrally formed on the connecting stub 28. The stubs 44 protrude beyond the engine connection flange 33 into the cylinder flange and bound the air passage 9. This results in a favorable shaping, and the cylinder flange can easily be removed from the mold during the production of the cylinder 2 by die-casting.

Figure 3:
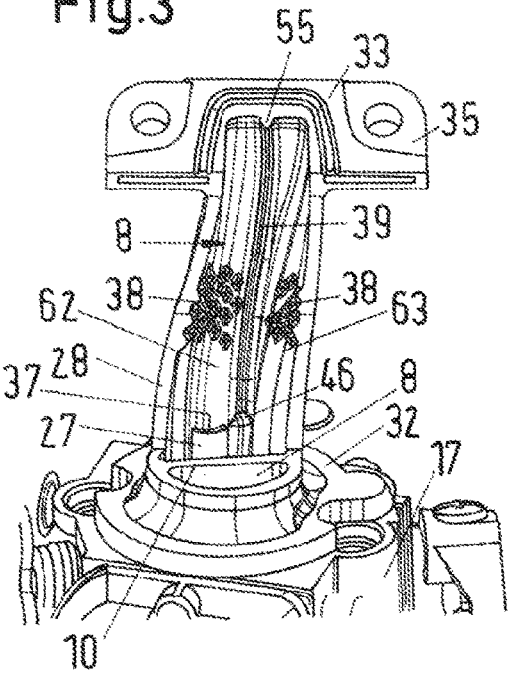
FIG. 3 shows a partially sectioned, perspective illustration of the connecting stub from FIG. 2, FIG. 4 and FIG. 5 show side views of the connecting stub.

As FIG. 3 shows, the guiding rib 39 has an upstream, carburetor-side end 46 which is offset from the carburetor connection flange 32 into the interior of the connecting stub 28. In addition, the guiding rib 39 has a downstream, engine-side end 55 which lies in the plane of the engine connection flange 33. The carburetor-side end 46 lies approximately at the height of the end of the shielding element 27.

Figure 7:
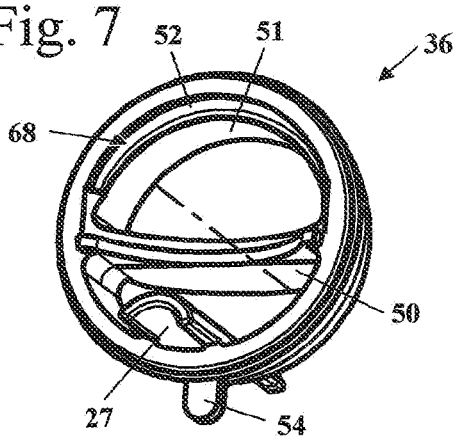
FIG. 7 shows a perspective illustration of an intermediate ring.
Figure 8:
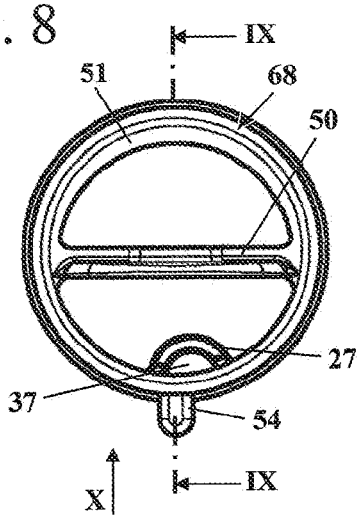
FIG. 8 shows a side view of the intermediate ring.

The guiding rib 39 divides the circumferential wall of the mixture passage 8 (FIG. 7) into a first circumferential section 62 and a second circumferential section 63. The shielding element 27 is offset in the circumferential direction in relation to the guiding rib 39, and therefore the secondary passage 37 opens at the first circumferential section 62. The guiding rib 39 serves to guide the flow toward the cylinder 2 in the direction of the longitudinal axis 65 of the intake passage. At the same time, the wall film of fuel precipitated in the first circumferential section 62 is prevented from migrating into the second circumferential section 63. This is advantageous in particular during idling. The fuel and the combustion air are guided directly to the cylinder 2 by the guiding rib 39. This prevents the fuel from being distributed throughout the entire connecting stub 28. As a result, fuel cannot pass into dead regions not having an air flow, and therefore an accumulation of fuel and an undefined, surge-like introduction of fuel into the crankcase 4 are avoided. In addition, the guiding rib 39 projecting into the mixture passage 8 evens out the flow in the mixture passage 8 and prevents turbulence in the flow.

Figure 4:
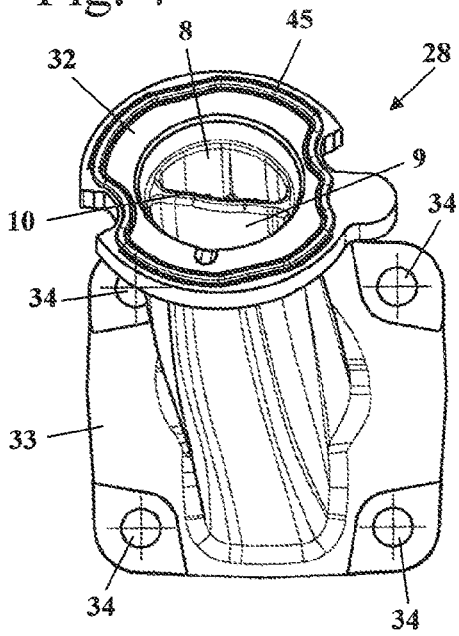

As FIG. 4 shows, a seal 45 which is integrally formed on the connecting stub 28 is provided on the carburetor connection flange 32.

Figure 5:
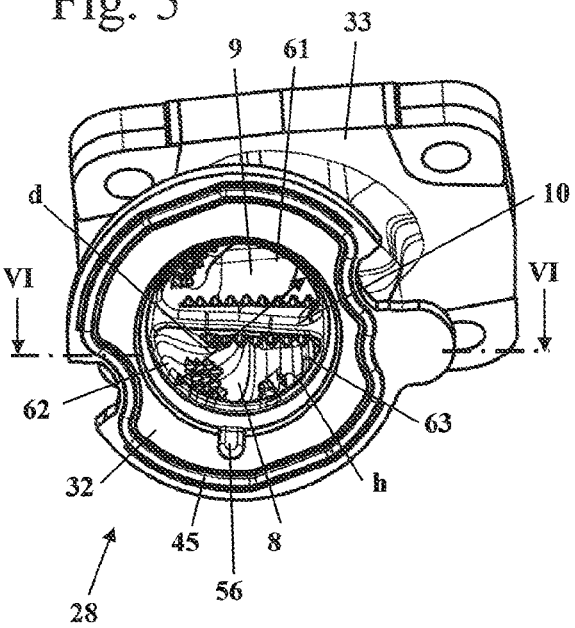

FIG. 5 shows the arrangement of the elevations 38. As FIG. 5 shows, elevations 38 are provided both in the air passage 9 and in the mixture passage 8. Elevations 38 are also arranged on both sides of the separating wall 10.

As FIG. 5 shows, the intake passage 61 on the carburetor connection flange 32 has a diameter d. The diameter d is therefore measured at the carburetor-side end 64 of the connecting stub 28. The height h of the guiding rib 39 is significantly smaller than the diameter d of the intake passage 61. The height h is advantageously approximately 5% to approximately 25%, in particular approximately 15% to approximately 20% of the diameter d of the intake passage 61. On the carburetor connection flange 32, the connecting stub 28 has a receptacle or notch 56 into which an element for positionally securing the intermediate ring 36 protrudes.

Figure 6:
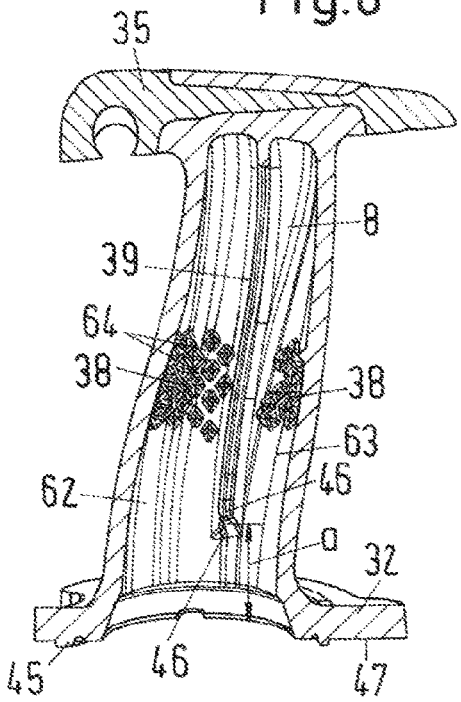
FIG. 6 shows a section through the connecting stub along the line VI-VI in FIG. 5.

FIG. 6 shows the configuration of the guiding rib 39 and the arrangement of the elevations 38. The carburetor-side end 46 of the guiding rib 39 is at a distance a from the connection surface 47 of the carburetor connection flange 32. The elevations 38 are arranged in such a manner that passages 64 which each run at an inclination with respect to the longitudinal axis 65 of the intake passage (FIG. 2) and which intersect are formed between the pyramid-shaped elevations 38. As a result, the accumulated fuel can be readily and uniformly conducted away to the combustion air flowing past. At the same time, a relatively large quantity of fuel can be picked up and temporarily stored.

Figure 9:
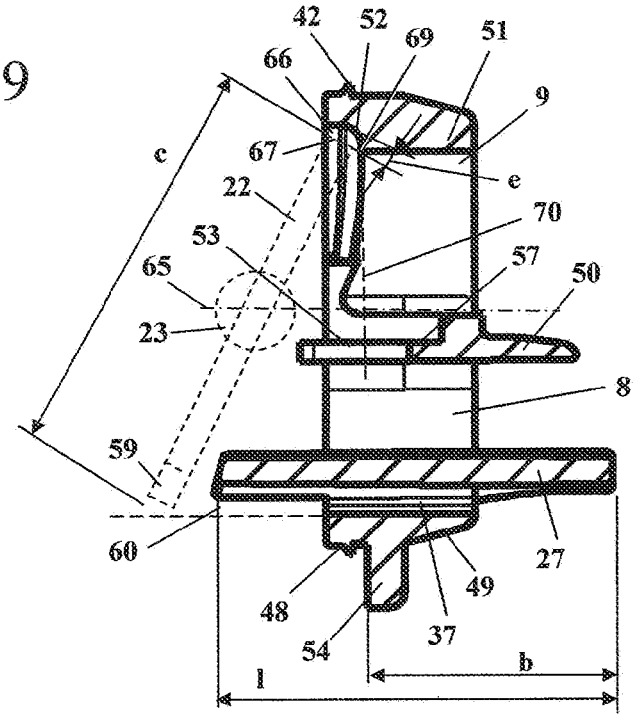
FIG. 9 shows a section along the line IX-IX in FIG. 8.
Figure 10:
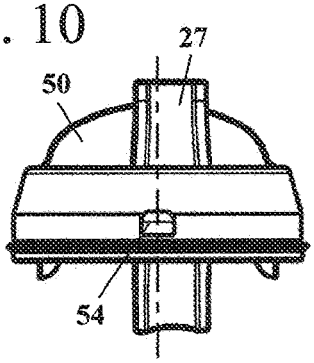
FIG. 10 shows a side view in the direction of the arrow X in FIG. 8.

FIGS. 7 to 10 show the configuration of the intermediate ring in detail. The intermediate ring 36 has an outwardly protruding positioning lug 54 which is arranged in the receptacle 56 of the connecting stub 28 (FIG. 5). As the figures show, the shielding element 27 is of curved design, wherein the concave side bounds the secondary passage 37. On the side opposite the shielding element 27, the secondary passage 37 is bounded by the outer wall of the mixture passage 8. This results in a very small flow cross section of the secondary passage 37. The secondary passage 37 is separated from the mixture passage 8 only by the shielding element 27 integrally formed on the intermediate ring 36. The shielding element 27 projects on both sides beyond the annular section of the intermediate ring 36 and projects into the carburetor 17 and the connecting stub 28. As the figures show, a separating wall section 50 is integrally formed on the intermediate ring 36. As FIG. 9 shows, a bearing surface 57 for the throttle valve 22 is formed on the separating wall section 50. On the section protruding into the connecting stub 28, the separating wall section 50 is of flattened design, and therefore the separating wall section 50 bears against the section of the separating wall 10 in the connecting stub 28 and thus leads to an increase in stability.

On the side bordering the air passage 9, the intermediate ring 36 has a thickened portion 51. As shown schematically in FIG. 9, when the throttle valve 22 is slightly open, for example during idling, a gap 66 is formed between the border of the throttle valve 22 and the intermediate ring 36, through which gap the combustion air flows. That side of the thickened portion 51 which faces the throttle valve 22 is formed in a radius 52, and therefore the air flowing past between the throttle valve 22 and the intermediate ring 26 is directed toward the mixture passage 8. The radius 52 on the thickened portion 51 therefore forms an air-guiding element 68. The radius 52 advantageously corresponds approximately to the thickness of the thickened portion 51. Owing to the fact that the radius 52 is significantly smaller than the radius of the throttle valve 22, the gap 66 does not have a constant width. However, the width e of the gap 66 is small and on average is advantageously between approximately 3% and approximately 10% of the diameter c of the throttle valve 22. The combustion air passing between the border 67 of the throttle valve 22 and the passage wall in the idling position shown in FIG. 9 is deflected by the air-guiding element 68 and flows through the opening 53 formed between the throttle valve 22 and the separating wall section 50. A flow separation edge 69 is formed at the transition from the air-guiding element 68 to the passage wall. The tangent 70 to the air-guiding element 68 at the flow separation edge 69 runs through the opening 53 in the separating wall 10. In the exemplary embodiment, the tangent 70 runs approximately perpendicularly to the longitudinal axis 65 of the intake passage. As a result, the combustion air passing between the throttle valve 22 and air-guiding element 68 is guided through the opening 53 into the mixture passage 8.

In the customary fitted position, the mixture passage 8 is advantageously arranged above the air passage 9, i.e. rotated through 180° with respect to the illustration in the figures. As a result, during idling, fuel may run as a wall film along the throttle valve 22 to the air passage 9. Said fuel is entrained by the combustion air flowing through the gap 66 and conveyed into the mixture passage 8.

In the exemplary embodiment, the opening 53 extends both upstream and downstream of the throttle shaft 23. However, provision may also be made for the opening 53 to be formed only between the throttle shaft 23 and separating wall section 50, i.e. only downstream of the throttle shaft 23.

As FIG. 9 shows, the intermediate ring 36 has a first fastening section 48 which protrudes into the carburetor 17 and bears a peripheral, outwardly protruding web 42, with which the fastening section 48 is held in a sealing manner in the carburetor 17. The web 42 is provided to compensate for tolerances and is deformed or sheared off during fitting such that the fastening section 48 always sits in a sealing manner in the carburetor 17 even in the event of unfavorable tolerance pairings. The second fastening section 49, which lies downstream and protrudes into the connecting stub 28, is of partially conically tapering design, and therefore the connecting stub 28 can be pushed in a readily sealing manner onto the intermediate ring 36.

As FIG. 9 shows, the intermediate ring 36 has an insertion length b into the connecting stub 28, which length preferably approximately corresponds to the distance a of the carburetor-side end 46 of the guiding rib 39. The shielding element 27, and therefore the secondary passage 36, has a length l which is preferably approximately 25% to approximately 150% of the diameter C of the throttle valve 22. A length l of the secondary passage 37 of preferably approximately 40% to approximately 100% of the diameter c of the throttle valve 22 is considered to be particularly advantageous. FIG. 9 also shows the entry opening 60 into the secondary passage 37 at the upstream end of the secondary passage 37. In the idling position of the throttle valve 22 that is shown in FIG. 9, the throttle valve 22 is adjacent to the entry opening 60. In this case, the opening 59 is arranged on the entry opening 60, and therefore combustion air can flow into the secondary passage 37 through the opening 59.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

The invention claimed is:

1. A two-stroke engine, comprising:

a cylinder, in which a combustion chamber is formed, wherein the combustion chamber is bounded by a piston which drives a crankshaft mounted rotatably in a crankcase, wherein the crankcase is connected in the region of the lower dead center of the piston via at least one overflow passage to the combustion chamber, with an intake passage, wherein a section of the intake passage is formed in a carburetor, wherein the intake passage is at least partially divided into an air passage and a mixture passage, wherein the mixture passage opens into the crankcase and the air passage supplies combustion air to an overflow passage, wherein air passage and mixture passage are at least partially separated from each other by a separating wall, wherein a throttle valve is mounted pivotably in the carburetor and controls the combustion air quantity supplied to the air passage and the mixture passage, wherein an air-guiding element is arranged on the passage wall of the air passage, wherein the throttle valve is mounted pivotably by using a throttle shaft, and wherein, in an idling position of the throttle valve, the air passage and the mixture passage are connected via an opening, which is arranged downstream of the throttle shaft, in the separating wall, through which opening air deflected by the air-guiding element flows, wherein the air-guiding element extends from the passage wall into the air passage, and wherein the air-guiding element is designed such that in the idling position of the throttle valve the air-guiding element directs guiding the combustion air passing through the air-guiding element further through the opening in the separating wall and into the mixture passage.

2. A two-stroke engine, comprising:

a cylinder, in which a combustion chamber is formed, wherein the combustion chamber is bounded by a piston which drives a crankshaft mounted rotatably in a crankcase, wherein the crankcase is connected in the region of the lower dead center of the piston via at least one overflow passage to the combustion chamber, with an intake passage, wherein a section of the intake passage is formed in a carburetor, wherein the intake passage is at least partially divided into an air passage and a mixture passage, wherein the mixture passage opens into the crankcase and the air passage supplies combustion air to an overflow passage, and wherein a throttle valve is mounted pivotably in the carburetor, and controls the combustion air quantity supplied to the air passage and the mixture passage, wherein air passage and mixture passage are at least partially separated from each other by a separating wall, wherein the throttle valve is mounted pivotably by using a throttle shaft, and wherein, in an idling position of the throttle valve, the air passage and the mixture passage are connected via an opening, which is arranged downstream of the throttle shaft, in the separating wall, through which opening air deflected by an air-guiding element flows, wherein the air-guiding element is arranged on the passage wall of the air passage, wherein the opening which is delimited by the air-guiding element, wherein in the idling position of the throttle valve the air passage and the mixture passage are connected via the opening, through which opening air deflected by the air-guiding element flows, wherein the air-guiding element has a flow separation edge, and wherein a tangent to the flow separation edge intersects the opening in the separating wall such that combustion air passing through the air-guiding element is at least partially guided through the through the opening into the mixture passage.

3. The two-stroke engine according to claim 1, wherein an intermediate ring is arranged downstream of the carburetor, the air-guiding element being integrally formed on the intermediate ring.

4. The two-stroke engine according to claim 3, wherein the air-guiding element is formed on the upstream side of the intermediate ring.

5. The two-stroke engine according to claim 3, wherein the intermediate ring is of thickened design on the side bounding the air passage, the air-guiding element being formed on the thickened portion.

6. The two-stroke engine according to claim 3, wherein a separating wall section is formed on the intermediate ring.

7. The two-stroke engine according to claim 3, wherein a connecting stub is arranged downstream of the carburetor, the intermediate ring being arranged between the carburetor and connecting stub.

8. The two-stroke engine according to claim 1, wherein the air-guiding element is of curved design in cross section.

9. The two-stroke engine according to claim 2, wherein the width of the gap that is formed between the throttle valve and the air guide in the idling position of the throttle valve is approximately 3% to approximately 10% of the diameter of the throttle valve.

10. A two-stroke engine, comprising:

a cylinder, in which a combustion chamber is formed, wherein the combustion chamber is bounded by a piston which drives a crankshaft mounted rotatably in a crankcase, wherein the crankcase is connected in the region of the lower dead center of the piston via at least one overflow passage to the combustion chamber, with an intake passage, wherein a section of the intake passage is formed in a carburetor, wherein the intake passage is at least partially divided into an air passage and a mixture passage, wherein the mixture passage opens into the crankcase and the air passage supplies combustion air to an overflow passage, and wherein a throttle valve is mounted pivotably in the carburetor, and controls the combustion air quantity supplied to the air passage and the mixture passage, wherein air passage and mixture passage are at least partially separated from each other by a separating wall, wherein the throttle valve is mounted pivotably by using a throttle shaft, and wherein, in an idling position of the throttle valve, the air passage and the mixture passage are connected via an opening, which is arranged downstream of the throttle shaft, in the separating wall, through which opening air deflected by an air-guiding element flows, wherein the air-guiding element is a thickened portion arranged on the passage wall of the air passage, wherein the thickened portion facing the throttle valve is formed in a radius, wherein in the idling position the side of the thickened portion facing the throttle valve directs combustion air flowing between the throttle valve and the thickened portion through the air-guiding element such that combustion air passing through the air-guiding element is at least partially guided through the through the opening into the mixture passage.

11. The two-stroke engine according to claim 1, wherein the air-guiding element and the opening are downstream of the throttle valve and a space in the separating wall accommodating the throttle valve.

12. The two-stroke engine according to claim 2, wherein the air-guiding element and the opening are downstream of the throttle valve and a space in the separating wall accommodating the throttle valve.

13. The two-stroke engine according to claim 10, wherein the air-guiding element and the opening are downstream of the throttle valve and a space in the separating wall accommodating the throttle valve.

* * * * *